US007859376B2

(12) United States Patent
Johnson, Jr.

(10) Patent No.: US 7,859,376 B2
(45) Date of Patent: Dec. 28, 2010

(54) ZIGZAG AUTOTRANSFORMER APPARATUS AND METHODS

(75) Inventor: Robert William Johnson, Jr., Raleigh, NC (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 12/335,940

(22) Filed: Dec. 16, 2008

(65) Prior Publication Data

US 2010/0148898 A1 Jun. 17, 2010

(51) Int. Cl.
*H01F 17/00* (2006.01)
*H01F 30/12* (2006.01)
*H01F 27/28* (2006.01)

(52) U.S. Cl. ..... 336/5; 323/355; 323/361; 336/221; 336/180

(58) Field of Classification Search ..... 336/180, 336/221, 220, 170; 323/355, 361
See application file for complete search history.

(56) References Cited

U.S. PATENT DOCUMENTS 5,982,262 A * 11/1999 Levin ..... 336/5
7,049,921 B2 5/2006 Owen
7,170,268 B2 * 1/2007 Kim ..... 323/272
7,274,280 B1 9/2007 Paice
2006/0126242 A1 * 6/2006 Datta et al. ..... 361/62
2007/0290670 A1 * 12/2007 Lee ..... 323/361

OTHER PUBLICATIONS

Catalog, ACME Electric, Power Distribution Products Division, 2005, pp. 1, 31, 156.*
Singh et al., "Zigzag Connected Autotransformer Based Controlled AC-DC Converter for Pulse Multiplication", 2007 IEEE Int'l Symposium on Ind. Electronics (ISIE), pp. 889-894 (Jun. 2007).

* cited by examiner

*Primary Examiner*—Anh T Mai
(74) *Attorney, Agent, or Firm*—Myers Bigel Sibley & Sajovec PA

(57) ABSTRACT

A zigzag autotransformer includes a zigzag transformer including first, second and third magnetic cores and an auxiliary winding set including respective pairs of series-connected windings on respective pairs of the first, second and third magnetic cores, the pairs of series-connected windings having respective first terminals connected to respective AC input phase terminals of the zigzag autotransformer and respective second terminals configured to provide respective AC output phases.

9 Claims, 4 Drawing Sheets

ZIGZAG AUTOTRANSFORMER APPARATUS AND METHODS

BACKGROUND OF THE INVENTION

The invention relates to power distribution apparatus and methods and, more particularly, to transformer apparatus and methods.

There is an ongoing quest for increased energy efficiencies in data centers and similar facilities. One technique for increasing efficiency is to increase the voltage used for power distribution in a facility. For example, current computer power supplies commonly can operate from 230V without modification. Replacing a 120/208V wye distribution system in a data center with a 230/400V wye system could allow elimination of isolation transformers used to step down to 120/208V, thus eliminating the approximate 2% loss associated with the isolation transformers.

In the U.S., however, facility power distribution systems commonly are 480V delta and, in rarer cases, 277/480V wye. Computer power supplies commonly cannot operate at 480V or 277V. Thus, provision of power to such devices may require either modification of the power supplies or conversion of the AC input to 230/400V wye.

A common approach illustrated in FIG. 1 is to use a delta-wye isolation transformer 10 to converter from 480V delta to 230/400V wye. This solution, however, typically comes at the cost of lost efficiency.

Another technique, illustrated in FIG. 2, involves using a zigzag transformer 20, which creates a neutral, and a separate autotransformer 30, which provides a voltage transformation. As illustrated in FIG. 3, the zigzag transformer 20 creates a synthetic neutral $H_0$ relative to phase conductors $H_1$, $H_2$, $H_3$. The zigzag transformer 20 includes windings 42*a*, 42*b*, 42*c* wound on respective cores 50*a*, 50*b*, 50*c*. The winding 42*a* is connected to a winding 44*b* on the core 50*b*, the winding 42*b* is connected to a winding 44*c* on the core 50*c*, and the winding 42*c* is connected to a winding 44*a* on the core 50*a*.

SUMMARY OF THE INVENTION

Some embodiments of the present invention provide a transformer including first, second and third magnetic cores, a first winding on the first magnetic core and having a first terminal configured to be connected to a first AC input phase, a second winding on the second magnetic core and having a first terminal configured to be connected to a second AC input phase, a third winding on the third magnetic core and having a first terminal configured to be connected to a third AC input phase, a fourth winding on the first magnetic core and having a first terminal connected to a second terminal of the third winding and a second terminal configured to be connected to an AC neutral, a fifth winding on the second magnetic core and having a first terminal connected to a second terminal of the first winding and a second terminal configured to be connected to the AC neutral and a sixth winding on the third magnetic core and having a first terminal connected to a second terminal of the second winding and a second terminal configured to be connected to the AC neutral. The transformer further includes a seventh winding on the first magnetic core and having a first terminal connected to the first terminal of the first winding, an eighth winding on the second magnetic core and having a first terminal connected to the first terminal of the second winding, a ninth winding on the third magnetic core and having a first terminal connected to the first terminal of the third winding, a tenth winding on the first magnetic core and having a first terminal connected to a second terminal of the ninth winding and a second terminal configured to provide a first AC output phase, an eleventh winding on the second magnetic core and having a first terminal connected to a second terminal of the seventh winding and a second terminal configured to provide a second AC output phase and a twelfth winding on the third magnetic core and having a first terminal connected to a second terminal of the eight winding and a second terminal configured to provide a third AC output phase. The first, second and third magnetic cores may include first, second and third cores of a three-phase magnetic core structure or the first, second and third magnetic cores may include respective discrete single-phase magnetic cores. The seventh, eighth, ninth, tenth, eleventh and twelfth windings may provide a voltage transformation between the first, second and third AC input phases and the first, second and third AC output phases of approximately 277V phase-to-neutral to 230V phase-to-neutral.

In further embodiments, a transformer includes a zigzag transformer comprising first, second and third magnetic cores. The transformer further includes an auxiliary winding set comprising respective pairs of series-connected windings on respective pairs of the first, second and third magnetic cores, the pairs of series-connected windings having respective first terminals connected to respective AC phases of the zigzag autotransformer and respective second terminals configured to provide respective AC output phases. The first, second and third magnetic cores may include first, second and third cores of a three-phase magnetic core structure or the first, second and third magnetic cores may include discrete single-phase magnetic cores. The auxiliary winding set may be configured to provide a voltage transformation between the first, second and third AC phases of the zigzag transformer and the first, second and third AC output phases of approximately 277V phase-to-neutral to 230V phase-to-neutral.

Additional embodiments of the present invention provide methods of operating a zigzag transformer comprising first, second and third magnetic cores. An auxiliary winding set is provided, the auxiliary winding set including respective pairs of series-connected windings on respective pairs of the first, second and third magnetic cores, the pairs of series-connected windings having respective first terminals connected to respective AC phases of the zigzag transformer. Respective phases of an AC source are connected to respective ones of the AC phases of the zigzag transformer to provide respective AC output phases at respective second terminals of the pairs of series-connected windings. An unbalanced load is connected to the second terminals of the pairs of series-connected windings.

DETAILED DESCRIPTION OF EXEMPLARY EMBODIMENTS

Figure 1:
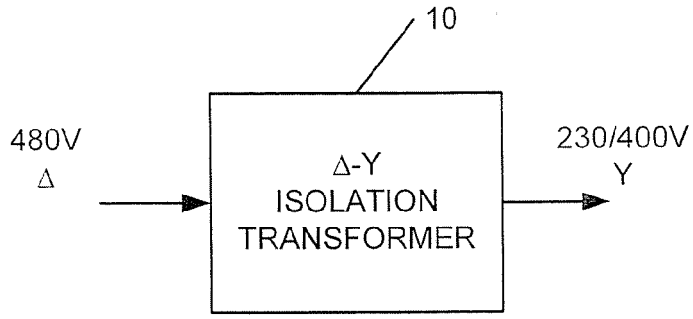
FIG. 1 PRIOR ART
FIG. 1 is a schematic diagram illustrating a conventional isolation transformer used for conversion between delta and wye distribution systems.
Figure 2:
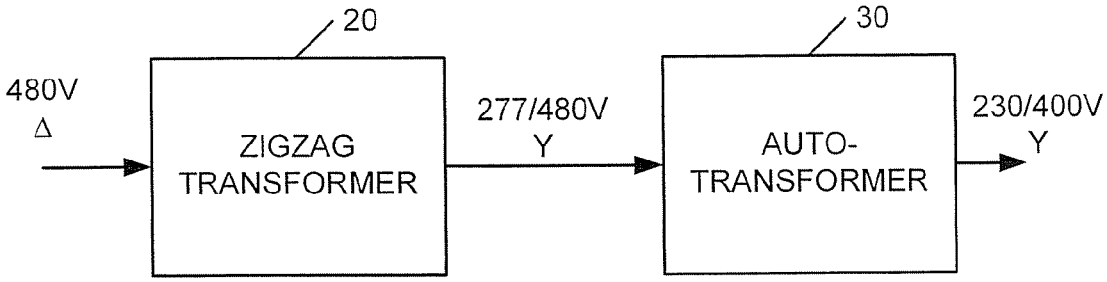
FIG. 2 PRIOR ART
FIG. 2 is a schematic diagram illustrating a conventional combination of a zigzag transformer and an autotransformer used for conversion between delta and wye distribution systems.
Figure 3:
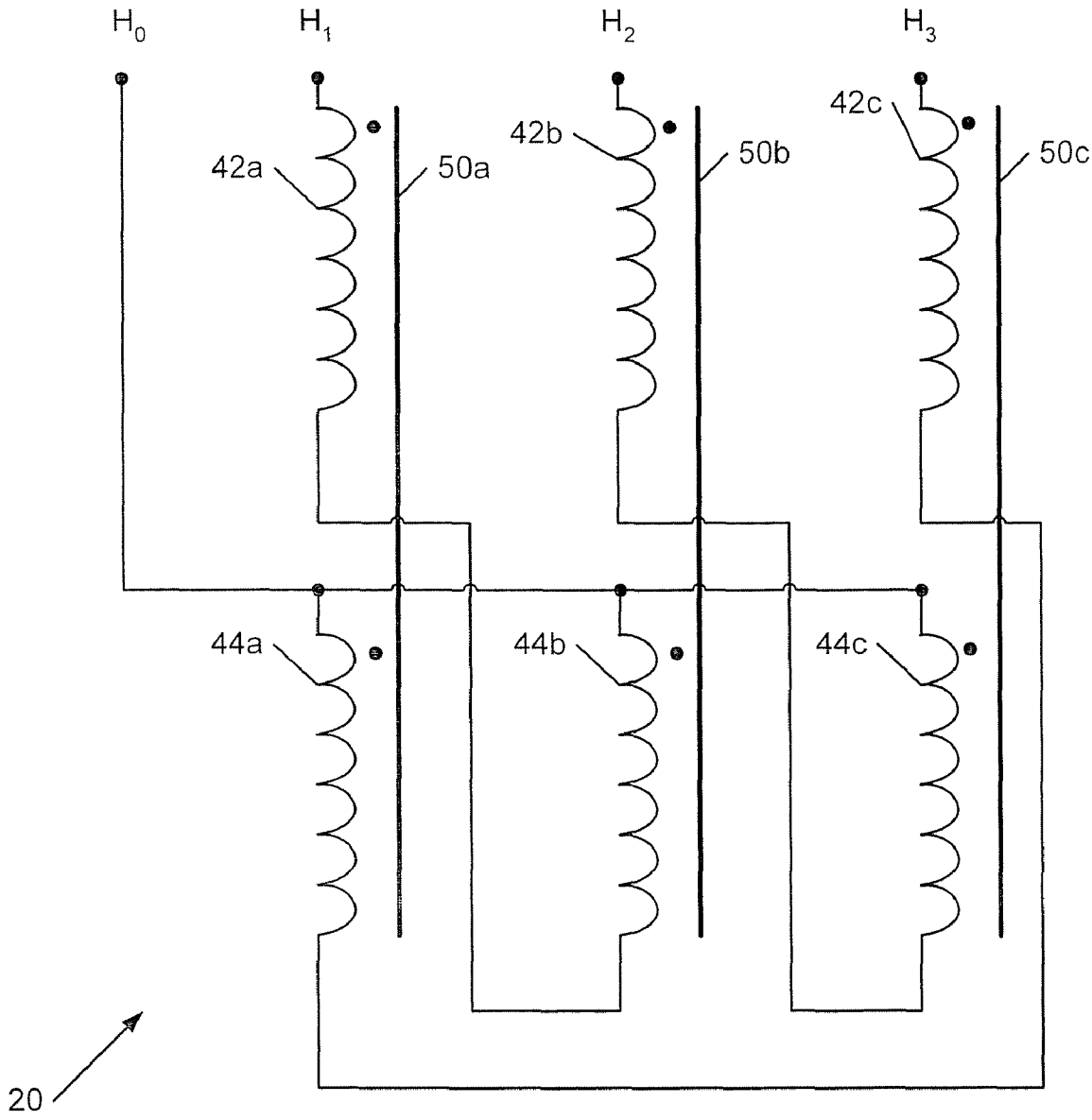
FIG. 3 PRIOR ART
FIG. 3 is a schematic diagram illustrating a conventional zigzag transformer.

Specific exemplary embodiments of the invention now will be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, like numbers refer to like elements. It will be understood that when an element is referred to as being "connected" or "coupled" to another element, it can be directly connected or coupled to the other element or intervening elements may be present. As used herein the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and the relevant art and will not be interpreted in an idealized or overly formal sense unless expressly so defined herein.

Figure 4:
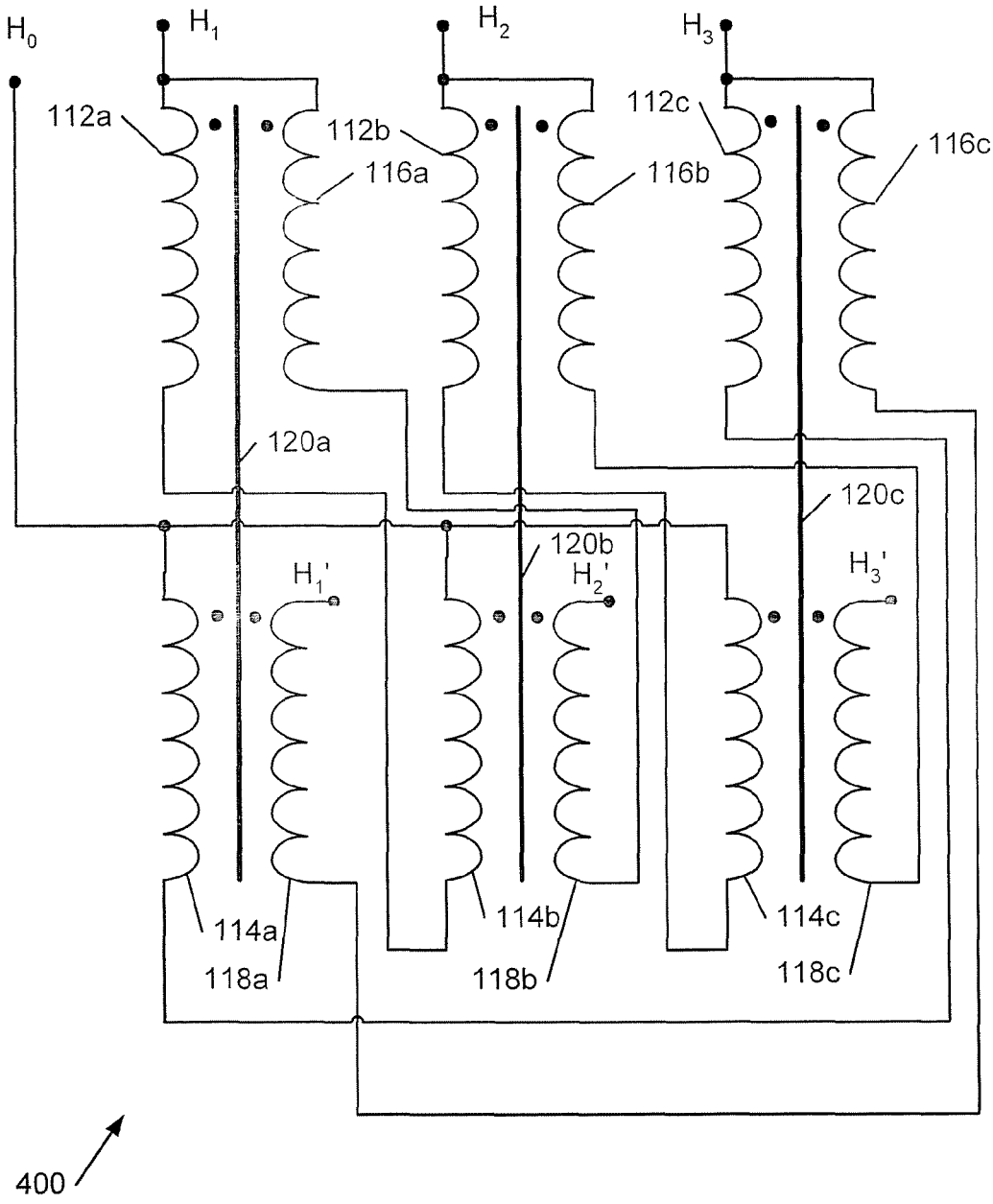
FIG. 4 is a schematic diagram illustrating a zigzag autotransformer according to some embodiments of the present invention.

FIG. 4 illustrates a transformer 400 according to some embodiments of the present invention. The transformer 400 includes first, second and third windings 112*a*, 112*b*, 112*c* on respective first, second and third cores 120*a*, 120*b*, 120*c*. The third winding 112*c* is connected to a fourth winding 114*a* on the first core 120*a*. The first winding 112*a* is connected to a fifth winding 114*b* on the second core 120*b*. The second winding 112*a* is connected to a sixth winding 114*c* on the third core 120*c*.

Additional series-connected pairs of windings are connected to AC input phase terminals $H_1$, $H_2$, $H_3$ and provide a voltage transformation between the voltages at the terminals $H_1$, $H_2$, $H_3$ and voltages at AC output phase terminals $H_1'$, $H_2'$, $H_3'$. In particular, seventh, eight and ninth windings 116*a*, 116*b*, 116*c* are provided on respective ones of the first, second and third cores 120*a*, 120*b*, 120*c*, and are connected to respective ones of the first, second and third windings 112*a*, 112*b*, 112*c*. A tenth winding 118*a* is on the first core 120*a* and is connected in series with the ninth winding 116*c*. An eleventh winding 118*b* is on the second core 120*b* and is connected in series with the seventh winding 116*a*. A twelfth winding 118*c* is on the third core 120*c* and is connected in series with the eighth winding 116*b*. According to some embodiments of the present invention, the seventh, eighth, ninth, tenth, eleventh and twelfth windings 116*a*, 116*b*, 116*c*, 118*a*, 118*b*, 118*c* support a translation from a V phase to neutral voltage at the terminals $H_1$, $H_2$, $H_3$ to a V phase to neutral voltage at the phase terminals $H_1'$, $H_2'$, $H_3'$.

The transformer 400 may be described as a zigzag transformer, including the first, second, third, fourth, fifth an sixth windings 112*a*, 112*b*, 112*c*, 114*a*, 114*b*, 114*c*, which provides a neutral, and an auxiliary winding set, including the seventh, eighth, ninth, tenth, eleventh and twelfth windings 116*a*, 116*b*, 116*c*, 118*a*, 118*b*, 118*c*, which provides a voltage transformation. The transformer 400 can be constructed using three individual cores for the cores 120*a*, 120*b*, 120*c*, or further reduction of the magnetic structure may be achieved by combining the three cores 120*a*, 120*b*, 120*c* in a single, three-phase core structure.

Figure 5:
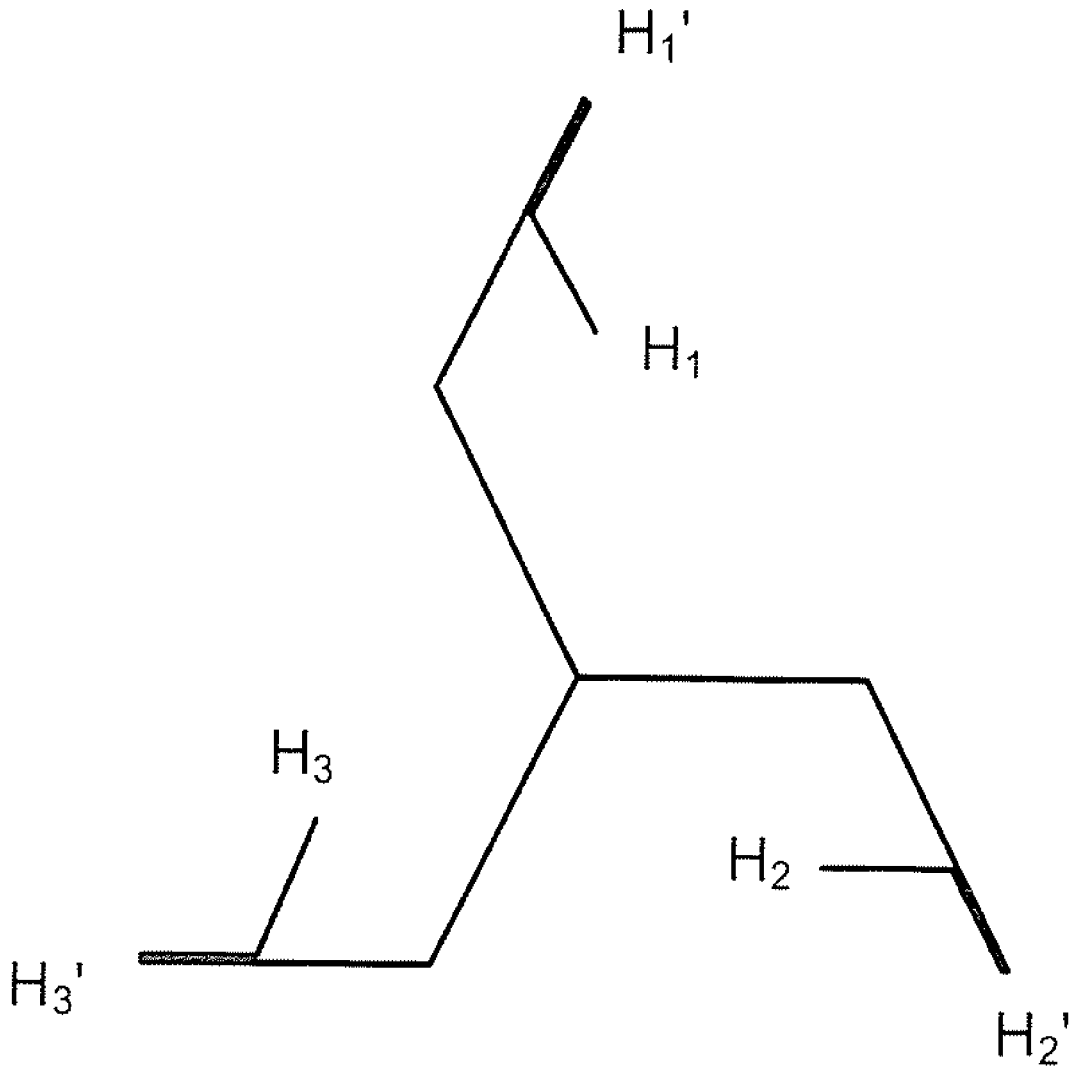
FIG. 5 is a phasor diagram for the zigzag autotransformer of FIG. 4.

Embodiments of the present invention may provide several advantages. Simply tapping a winding of a zigzag transformer (e.g., the transformer of FIG. 1) could provide the desired voltage reduction (i.e., 227V to 230V phase to neutral), but this voltage may fluctuate if the load is unbalanced. Providing a zigzag voltage reduction, for example, as described above for the embodiments of the present invention illustrated in FIG. 4, may provide a stiffer voltage to support an unbalanced load connected to the AC output phase terminals $H_1'$, $H_2'$, $H_3'$. In addition, the transformer 400 may provide a negligible phase shift, as illustrated in FIG. 5.

In the drawings and specification, there have been disclosed exemplary embodiments of the invention. Although specific terms are employed, they are used in a generic and descriptive sense only and not for purposes of limitation, the scope of the invention being defined by the following claims.

That which is claimed is:

1. A transformer comprising:

first, second and third magnetic cores;

a first winding on the first magnetic core and having a first terminal configured to be connected to a first AC input phase;

a second winding on the second magnetic core and having a first terminal configured to be connected to a second AC input phase;

a third winding on the third magnetic core and having a first terminal configured to be connected to a third AC input phase;

a fourth winding on the first magnetic core and having a first terminal connected to a second terminal of the third winding and a second terminal configured to be connected to an AC neutral;

a fifth winding on the second magnetic core and having a first terminal connected to a second terminal of the first winding and a second terminal configured to be connected to the AC neutral;

a sixth winding on the third magnetic core and having a first terminal connected to a second terminal of the second winding and a second terminal configured to be connected to the AC neutral;

a seventh winding on the first magnetic core and having a first terminal connected to the first terminal of the first winding;

an eighth winding on the second magnetic core and having a first terminal connected to the first terminal of the second winding;

a ninth winding on the third magnetic core and having a first terminal connected to the first terminal of the third winding;

a tenth winding on the first magnetic core and having a first terminal connected to a second terminal of the ninth winding and a second terminal configured to provide a first AC output phase;

an eleventh winding on the second magnetic core and having a first terminal connected to a second terminal of the seventh winding and a second terminal configured to provide a second AC output phase; and a twelfth winding on the third magnetic core and having a first terminal connected to a second terminal of the eight winding and a second terminal configured to provide a third AC output phase.

2. The transformer of claim 1, wherein the first, second and third magnetic cores comprise first, second and third cores of a three-phase magnetic core structure.

3. The transformer of claim 1, wherein the first, second and third magnetic cores comprise discrete single-phase magnetic cores.

4. The transformer of claim 1, wherein the seventh, eighth, ninth, tenth, eleventh and twelfth windings provide a voltage transformation between the first, second and third AC input phases and the first, second and third AC output phases of approximately 277V phase-to-neutral to 230V phase-to-neutral.

5. A transformer comprising:

a zigzag transformer comprising first, second and third magnetic cores; and an auxiliary winding set comprising respective pairs of series-connected windings on respective pairs of the first, second and third magnetic cores, the pairs of series-connected windings having respective first terminals connected to respective AC phases of the zigzag autotransformer and respective second terminals configured to provide respective AC output phases.

6. The transformer of claim 5, wherein the first, second and third magnetic cores comprise first, second and third cores of a three-phase magnetic core structure.

7. The transformer of claim 5, wherein the first, second and third magnetic cores comprise discrete single-phase magnetic cores.

8. The transformer of claim 5, wherein the auxiliary winding set is configured to provide a voltage transformation between the first, second and third AC phases of the zigzag transformer and the first, second and third AC output phases of approximately 277V phase-to-neutral to 230V phase-to-neutral.

9. A method of operating a zigzag transformer comprising first, second and third magnetic cores, the method comprising:

providing an auxiliary winding set comprising respective pairs of series-connected windings on respective pairs of the first, second and third magnetic cores, the pairs of series-connected windings having respective first terminals connected to respective AC phases of the zigzag transformer;

connecting respective phases of an AC source to respective ones of the AC phases of the zigzag transformer to provide respective AC output phases at respective second terminals of the pairs of series-connected windings; and connecting an unbalanced load to the second terminals of the pairs of series-connected windings.

* * * * *